US007257909B2

(12) United States Patent
Shaffer et al.

(10) Patent No.: US 7,257,909 B2
(45) Date of Patent: Aug. 21, 2007

(54) CONVERTIBLE YARD TOOL

(75) Inventors: Chadwick A. Shaffer, Oakdale, MN (US); John O. Hurst, Savage, MN (US)

(73) Assignee: The Toro Company, Bloomington, MN (US)

( * ) Notice: Subject to any disclaimer, the term of this patent is extended or adjusted under 35 U.S.C. 154(b) by 40 days.

(21) Appl. No.: 10/975,683

(22) Filed: Oct. 27, 2004

(65) Prior Publication Data

US 2006/0096136 A1 May 11, 2006

(51) Int. Cl.
*E01H 5/04* (2006.01)

(52) U.S. Cl. ..... 37/242; 37/232; 37/254; 37/246

(58) Field of Classification Search ..... 37/241, 37/242, 232, 233, 253, 254, 257, 246, 244, 37/221, 238

See application file for complete search history.

(56) References Cited

U.S. PATENT DOCUMENTS

| | | | | |
|---|---|---|---|---|
| 3,221,481 | A | | 12/1965 | Mattson et al. |
| 3,330,102 | A | | 7/1967 | Schuman, Jr. |
| 3,341,235 | A | | 9/1967 | Mattson et al. |
| 3,350,864 | A | | 11/1967 | Sheps et al. |
| 3,561,199 | A | | 2/1971 | Lay |
| 3,627,054 | A | | 12/1971 | Lay |
| 3,735,510 | A | * | 5/1973 | Godfrey et al. ..... 37/248 |
| 3,758,967 | A | * | 9/1973 | Thompson ..... 37/242 |
| 4,064,679 | A | * | 12/1977 | Spinner ..... 56/2 |
| 4,190,972 | A | | 3/1980 | Berner |
| 4,255,880 | A | | 3/1981 | McMickle et al. |
| 4,295,285 | A | | 10/1981 | Stevens |
| 4,329,792 | A | | 5/1982 | Berner |
| 4,378,644 | A | | 4/1983 | Tuggle et al. |
| 4,505,040 | A | | 3/1985 | Everts |
| 4,894,914 | A | | 1/1990 | Mead |
| 5,161,318 | A | | 11/1992 | Bergman et al. |
| 5,269,082 | A | | 12/1993 | Sund et al. |
| 5,398,431 | A | | 3/1995 | Beihoffer et al. |
| 5,520,253 | A | * | 5/1996 | Kesting ..... 172/125 |
| 5,522,162 | A | | 6/1996 | Allison |
| 5,553,406 | A | | 9/1996 | Cerny |
| 5,560,108 | A | | 10/1996 | Wilson |
| 5,603,173 | A | | 2/1997 | Brazell |
| D380,129 | S | | 6/1997 | Meisner et al. |
| D382,450 | S | | 8/1997 | Meisner et al. |
| D382,778 | S | | 8/1997 | Meisner et al. |
| 5,662,428 | A | | 9/1997 | Wilson |
| 5,771,582 | A | | 6/1998 | Tuggle |
| 5,867,911 | A | | 2/1999 | Yates et al. |
| D406,225 | S | | 3/1999 | Searle et al. |
| 5,933,966 | A | | 8/1999 | Yates et al. |
| 6,076,265 | A | | 6/2000 | Huang Lo |
| 6,182,383 | B1 | | 2/2001 | Reed, Jr. |

(Continued)

*Primary Examiner*—Thomas A Beach
(74) *Attorney, Agent, or Firm*—Fulbright & Jaworski L.L.P.

(57) ABSTRACT

A convertible yard tool is disclosed having an implement connected for rotation within a housing, wherein the implement and housing are operated relative to a ground surface in either a snow throwing orientation or a sweeping orientation. When operated in the snow throwing orientation and with the implement being a snow throwing impeller, the yard tool can be used to remove snow from a surface. When operated in the sweeping orientation and with the implement being a broom, the yard tool can be used to move debris from a surface to be cleaned. An adjustable handle may be provided to facilitate movement of the yard tool across various surfaces.

18 Claims, 8 Drawing Sheets

U.S. PATENT DOCUMENTS

| | | | | |
|---|---|---|---|---|
| D440,131 | S | 4/2001 | Aglassinger et al. | |
| 6,301,866 | B1 | 10/2001 | Marshall et al. | |
| D450,226 | S | 11/2001 | Martin | |
| 6,327,781 | B1 | 12/2001 | Sinclair et al. | |
| D457,403 | S | 5/2002 | Cooper | |
| 6,439,088 | B1 | 8/2002 | Eytchison et al. | |
| 6,516,598 | B1 | 2/2003 | Notaras et al. | |
| D473,114 | S | 4/2003 | Van Wambeke et al. | |
| D473,115 | S | 4/2003 | Van Wambeke et al. | |
| 6,560,905 | B2 * | 5/2003 | Monroe | 37/248 |
| 6,581,246 | B1 | 6/2003 | Polette | |
| D479,676 | S | 9/2003 | Van Wambeke et al. | |
| D479,677 | S | 9/2003 | Van Wambeke et al. | |
| D479,962 | S | 9/2003 | Van Wambeke et al. | |
| 6,643,958 | B1 | 11/2003 | Krejci | |
| 6,643,959 | B2 | 11/2003 | Jolliff et al. | |
| D483,236 | S | 12/2003 | Martin et al. | |
| 6,926,091 | B2 * | 8/2005 | Lee | 172/52 |

* cited by examiner

CONVERTIBLE YARD TOOL

TECHNICAL FIELD

This invention relates in general to a yard tool for clearing snow and debris from a ground surface such as a sidewalk or driveway. More particularly, this invention relates to a portable yard tool having a snow throwing mode of operation and a debris sweeping mode of operation.

DESCRIPTION OF THE PRIOR ART

Various types of snow removal machines, commonly referred to as snowblowers or snowthrowers, have been developed and used in place of manual snow shoveling. A small electrically operated snowthrower has been developed to replace the more conventional manual shovels and the larger motorized snowblowers currently in use. This snowthrower is configured to act much like a shove and, in fact, is manipulated by the user in a manner similar to a shovel. The snowthrower has a small housing at one end of an elongated handle that extends upwardly from the housing. The housing includes a relatively open impeller and a small electric motor for rotating the impeller. A scraper bar is provided adjacent the bottom edge of the rear wall of the housing to allow the housing to bite into the snow. The rear wall of the housing also includes a guide section and an arcuate portion which conforms to the periphery of the impeller. As the impeller rotates, the blades of the impeller contact and move the snow through the housing and eventually throw the snow up along the guide section of the rear wall to a position distally located from the thrower. One such electric snowthrower is disclosed in U.S. Pat. No. 4,295,285 to Stevens, entitled Snowthrower, and incorporated by reference herein.

Various types of rotary sweeping machines have also been developed. One type of sweeping tool provides a hand-held portable device having an elongate boom and having a power generation means disposed at one end thereof and a power sweeping means disposed at the other end. Such an rotary sweeping device is disclosed in U.S. Pat. No. 5,269,082 to Sund et al.

SUMMARY OF THE INVENTION

The present invention relates to a readily portable hand held yard tool useful for removal of snow and debris such as leaves, sand, dirt, small rocks and the like from sidewalks, driveways, decks, roofs or similar surfaces, as wells as from lawns without damage to the grass. In a preferred embodiment, the yard tool has a lower housing containing an implement and power generation means for rotating the implement. An elongate handle extends upwardly from the housing and a control grip is disposed at an upper portion of the handle.

The present invention further relates to a yard tool which is readily convertible between a snow removal mode of operation and a sweeping mode of operation. In embodiments of the invention, a pair of rotatable implements may be provided including a generally open snow impeller and an elongated sweeping broom. In embodiments of the invention, the conversion between snow removal and sweeping mode of operation is achieved by exchanging the implements, e.g., the rotatable snow impeller for the sweeping broom. Preferably, means are provided to facilitate quick removal and exchange of these implements. In embodiments of the invention, a housing containing the rotatable implement is supported on a ground surface in different operational orientations.

In a preferred embodiment of the present invention, provisions are made for a yard tool having a rotatable handle assembly which provides a control grip in generally the same orientation to the user during two different modes of tool operation, even though the housing is supported upon the ground surface in different orientations.

Operationally, the implements of the yard tool are rotated by a power generation means, such as an electric motor or internal combustion engine. The implements operate to push against and move material such as snow and debris that has collected on a surface to be cleaned.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

This invention will be described in more detail in the following Detailed Description, when taken in conjunction with the following drawings, in which like reference numerals refer to like elements throughout.

DETAILED DESCRIPTION OF A PREFERRED EMBODIMENT

Figure 1:
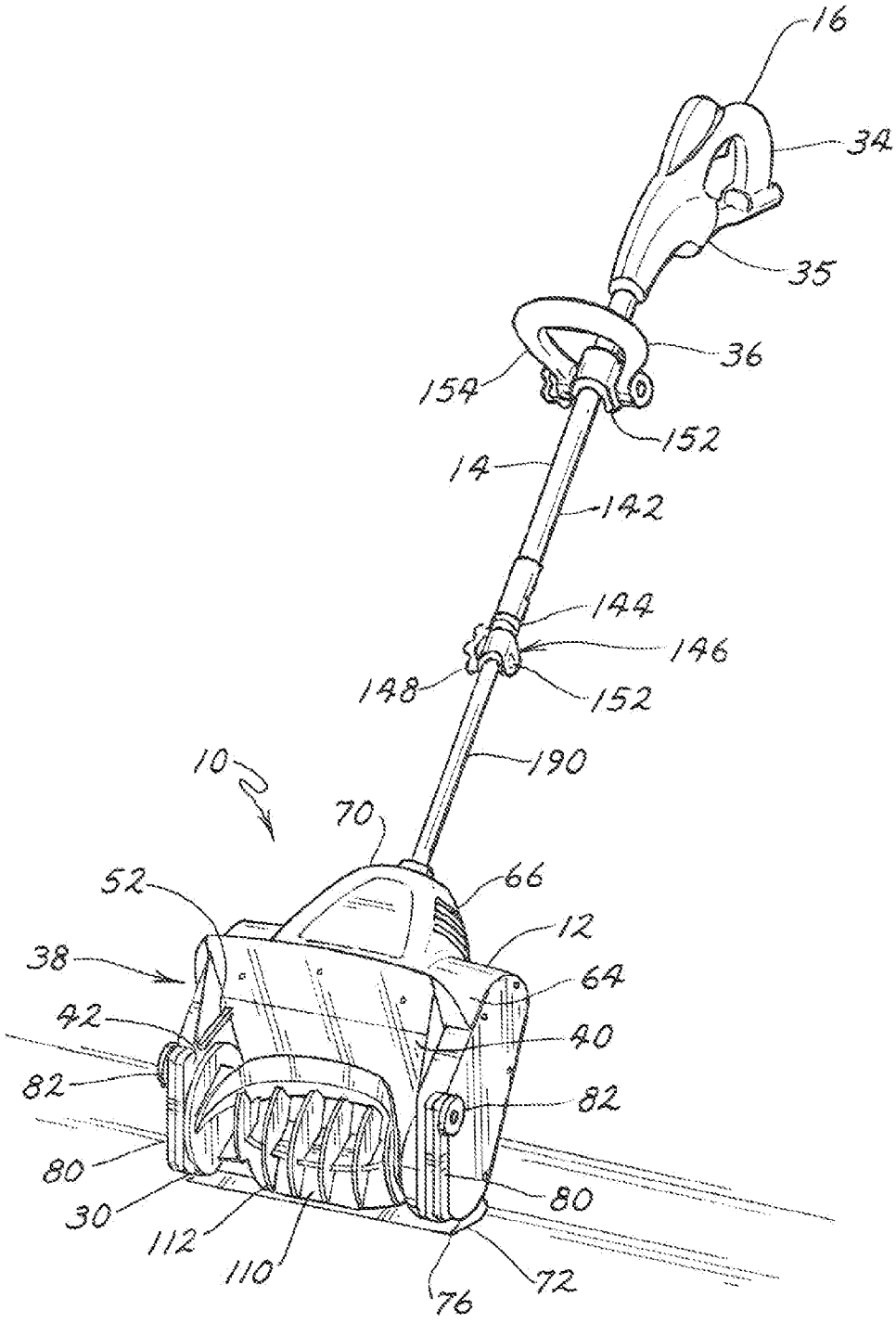
FIG. 1 is a perspective view of an embodiment of an improved yard tool according to this invention.
Figure 2:
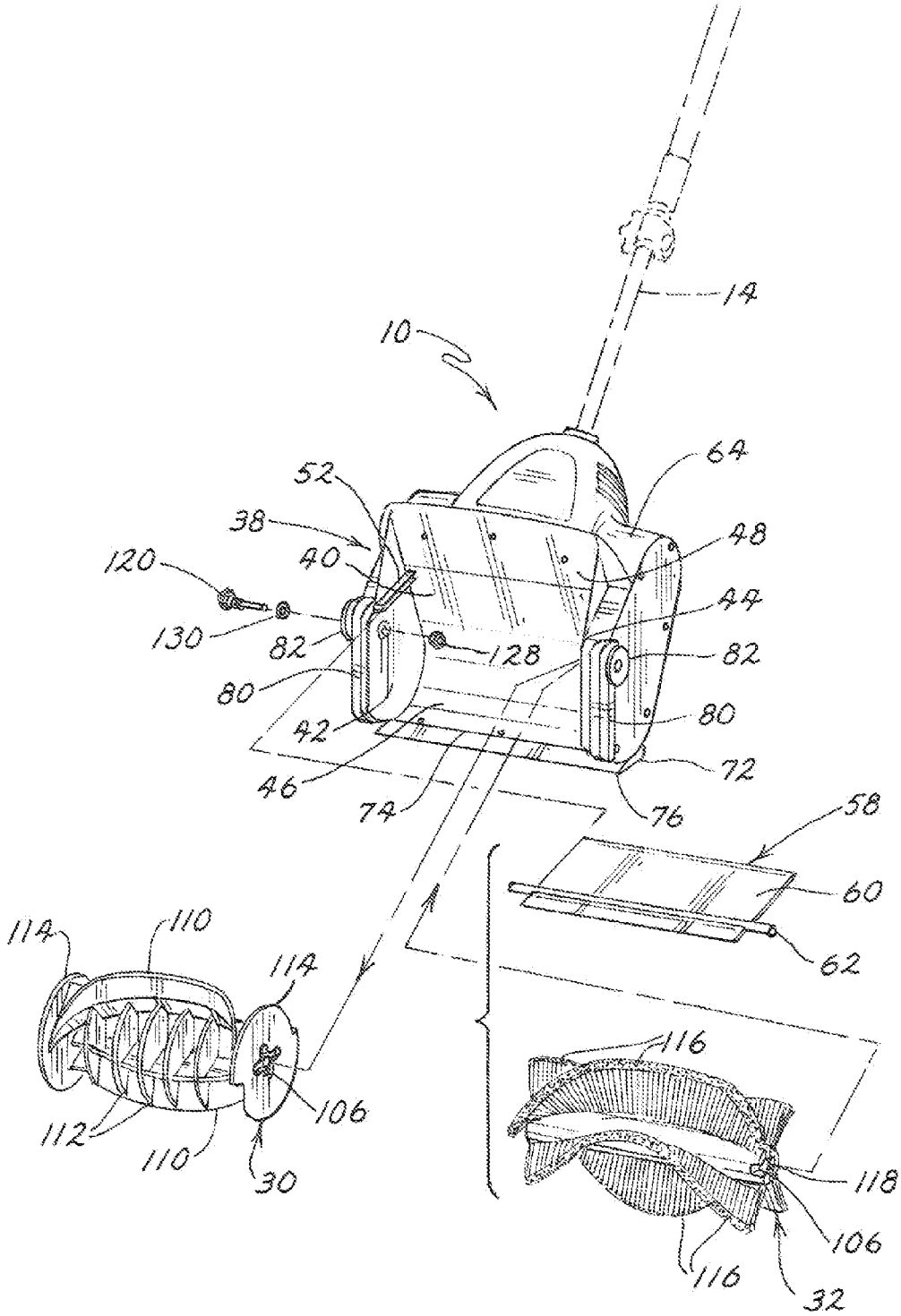
FIG. 2 is a partially-exploded perspective view of an embodiment of an improved yard tool according to this invention.

Referring to FIGS. 1-9, one embodiment of the present invention is disclosed wherein an improved yard tool according to this invention is generally illustrated as numeral 10. Yard tool 10 includes a housing 12, an elongated handle assembly 14 extending upwardly away from the housing 12, and a control grip 16 at an upper portion of handle assembly 14. Housing 12 contains an implement and electric drive motor 22 for rotating the implement. As illustrated in FIG. 2, two different rotatable implements may be positioned within housing 12, including a snow-engaging impeller 30 and a generally cylindrical broom 32. As described in more detailed herein, implements 30, 32 are interchangeable and are selectively mounted for rotation inside housing 12 depending on the intended use of the yard tool 10. In a preferred embodiment of the invention, two general modes of operation of the yard tool 10 include a snow throwing mode and a debris sweeping mode as described in detail hereinafter. In other embodiments of the present invention, different implements may be utilized including, but not limited to, detatchers, cylindrical rakes, etc.

Elongated handle assembly 14 extends upwardly from the top of housing 12. Control grip 16 is positioned at the upper portion of handle assembly 14 and provides a means by which the user can hold yard tool 10 during operation. In addition, control grip 16 encloses a switch 34, an optionally an interlock or safety switch, for controlling the actuation of drive motor 22. Control grip 16 also includes a power plug 35 adapted to be connected to an extension cord. A conductor (not shown) extends down through handle assembly 14 to motor 22.

An assist handle 36, positioned between the upper portion of the handle assembly and the housing 12, provides additional user support and control of yard tool 10. As further described herein, the upper portion of handle assembly 14 is capable of being rotated relative to the housing 12 to reorient the control grip 16 relative to the housing 12 and ground surface. Such rotation of the upper portion of the handle assembly 14 and control grip 16 relative to the housing 12 may occur during a change from the snow throwing mode to the debris sweeping mode of operation.

Figure 4:
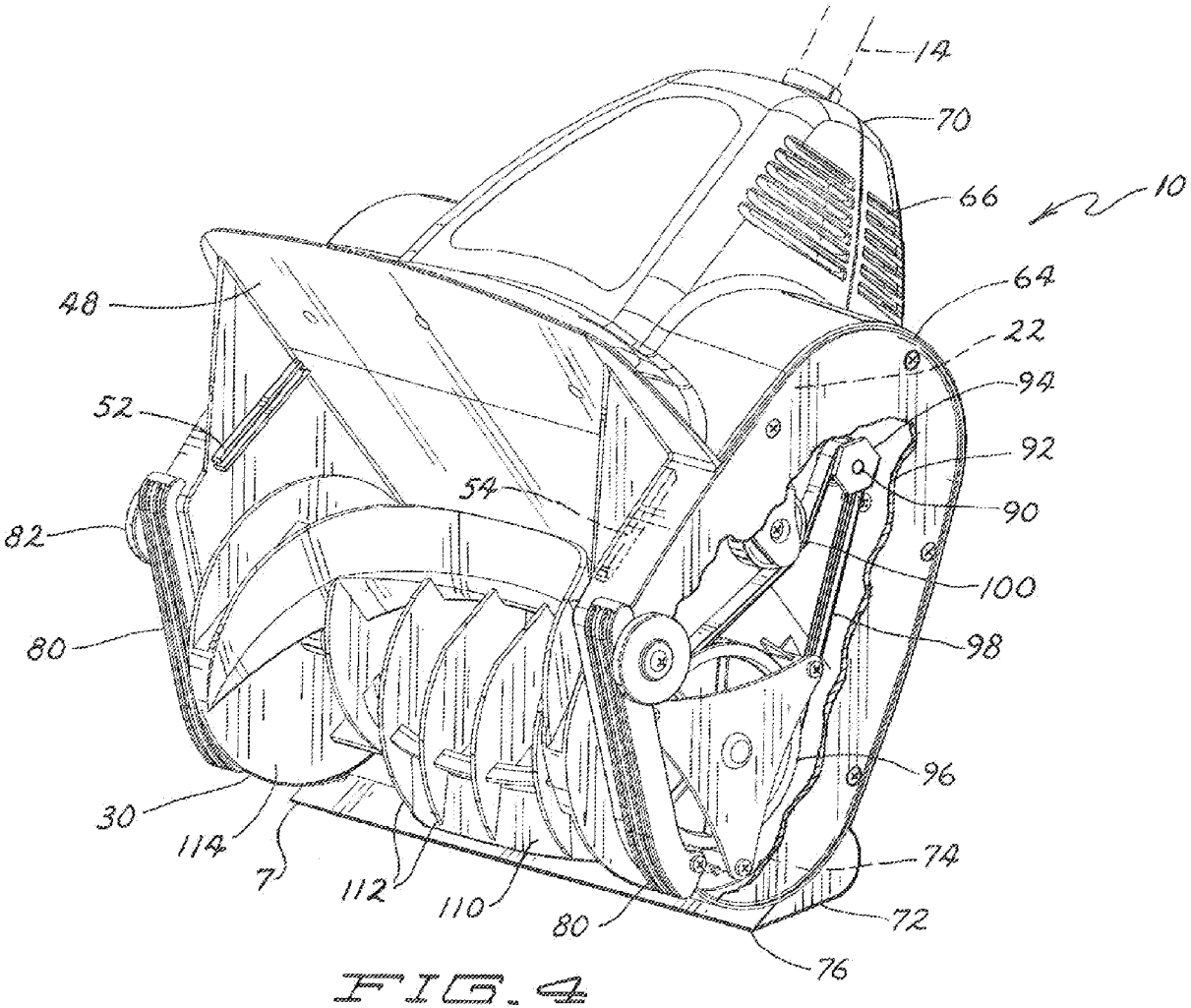
FIG. 4 is a partial perspective view of the yard tool of FIG. 2 provided in a snow throwing configuration, with portions thereof broken away.
Figure 5:
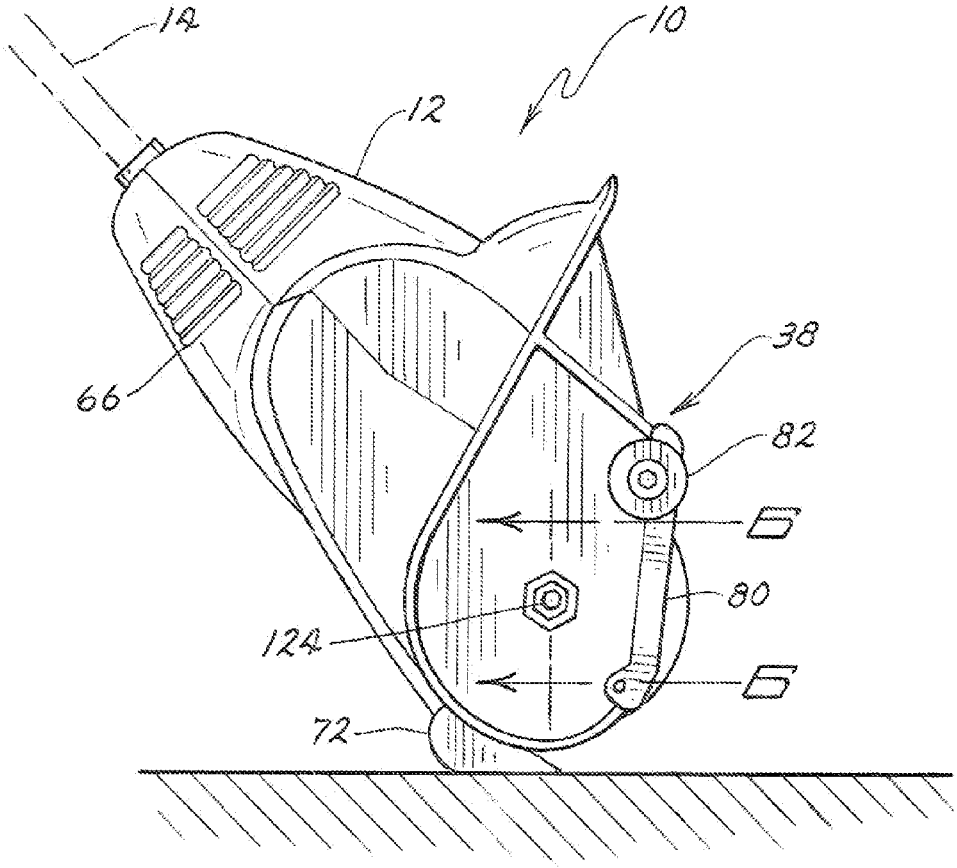
FIG. 5 is a side elevational view of the yard tool of FIG. 4.

With reference to FIGS. 1, 2 and 4, housing 12 includes an implement containing compartment 38. Compartment 38 is generally open and is defined by a wall 40 bounded at either side by left and right end walls 42 and 44. Wall 40 includes an arcuate portion 46 which conforms generally to the periphery of the implements 30, 32. In addition, wall 40 includes a guide portion 48 which extends forwardly from arcuate portion 46. When yard tool 10 is used in the snow throwing mode of operation (such as illustrated in FIG. 1), wall 40 can be considered a rear wall as it is positioned behind the impeller 30 during a forward motion of tool 10. In the snow throwing mode of operation, rear wall 40 and the arcuate guide portion 46 coact with impeller 30 to cause snow which is picked up by impeller 30 to be thrown outwardly from housing 12 along guide portion 48. Together, rear wall 40 and the left and right end walls 42 and 44 define portions of compartment 38 of housing 12 which is generally open.

In a preferred embodiment, housing 12 comprises a plurality of panels, walls and surfaces and may be assembled from parts of different materials, including plastic, metal, fiberglass or other composites, etc. A frame may optionally be included within the housing 12 to support elements such as electric motor 22 and handle assembly 14. Various motor mounts, electrical connections, cavities or components may also be included within the housing 12. The term "housing" is broadly defined to include a variety of different structures suitable for use to carry various functional and/or ornamental components of the tool 10 opposite the control grip 16. As used herein, the term "housing" broadly defines a structure capable of carrying rotating implements 30, 32 relative to a surface to be cleaned.

Figure 9:
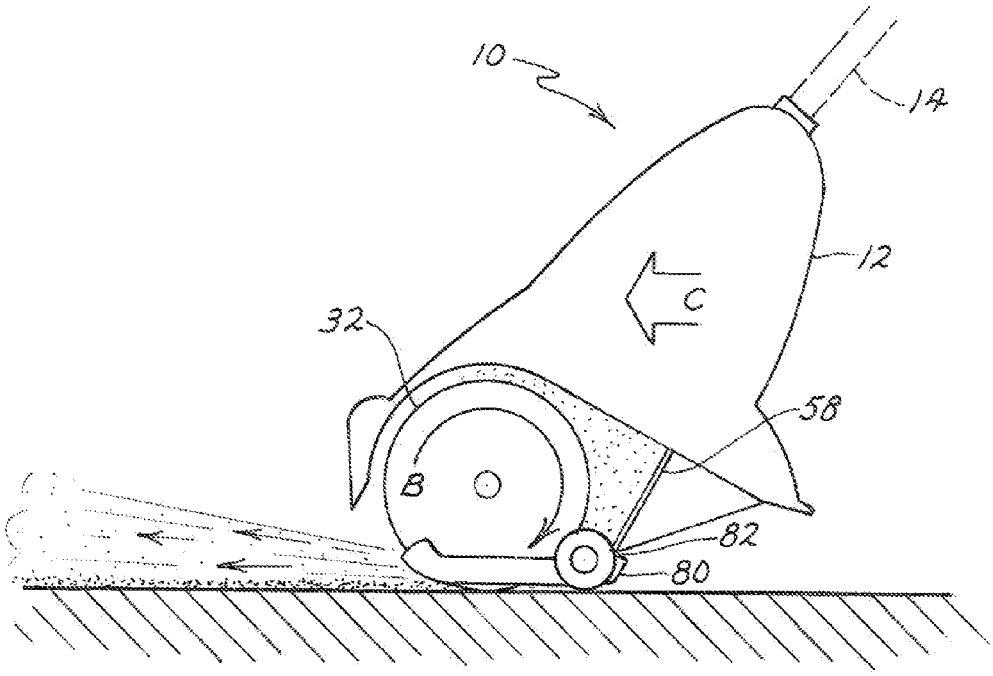
FIG. 9 is a depiction of an embodiment of an improved yard tool according to the present invention operating in a debris sweeping configuration.

Left and right end walls 42 and 44 each include a channel 52, 54 for temporarily receiving and supporting a removable shield 58 which is intended to be used only during the sweeping mode of operation to control debris thrown from the yard tool 10. Removable shield 58, as illustrated in FIGS. 2 and 9, includes a generally planar flexible panel 60 attached to a rod element 62. In application, panel 60 of shield 58 engages the channels 52, 54, and the two ends of rod element 62 each engage a rear surface on associated skids 80 to temporarily secure the shield 58 to the housing 12.

Housing 12 also includes a hollow motor compartment 64 located behind impeller containing compartment 38. A top wall of compartment 64 has a plurality of slots or air passageways 66 formed therein. Slots 66 provide both air inlet and outlet passages to the motor containing compartment 64. In addition, housing 12 includes an upwardly extending handle support member 70. Handle support member 70 includes a circular bore which receives and supports the lower end of handle assembly 14.

Figure 8:
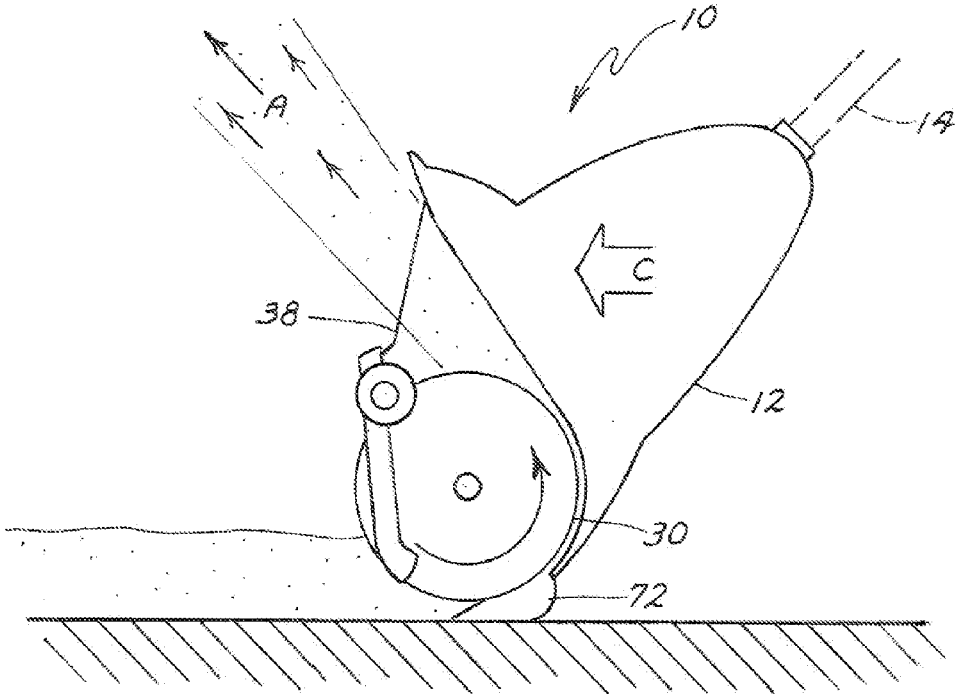
FIG. 8 is a depiction of an embodiment of an improved yard tool according to the present invention operating in a snow throwing configuration.

Yard tool 10 includes various elements for supporting the housing 12 upon a ground or snow surface. In the illustrated embodiment, the support elements include a scraper bar 72, a pair of skids 80 and wheels 82. Scraper bar 72 is releasably secured to the wall 40 adjacent edge 74 of the arcuate portion 46 of wall 40. During operation of yard tool 10 in a snow throwing operation, as depicted in FIG. 8, a knife edge 76 of scraper bar 72 bites into the snow contained on a ground surface. Yard tool 10 also includes a pair of skids 80 and wheels 82 which may engage the ground surface when yard tool 10 is used in the sweeping mode of operation. Skids 80 are releasably secured to the housing 12 to allow for periodic replacement. Skids 80 may be formed of a high molecular weight plastic material, such as a modified polypropylene. Skids 80 and wheels 82 may be manufactured of variety of different materials including, but not limited to, metals, plastics and fiber-based composite materials. During operation of yard tool 10 in the debris sweeping mode of operation, as depicted by FIG. 9, the wheels 82 and/or skids 80 engage the ground surface.

Drive motor 22 is fixedly contained in any suitable manner inside motor compartment 64. Drive motor 22 is preferably a small lightweight electric motor. Although an electric motor is preferred, any suitable drive motor could be used in its place. For example, an internal combustion engine may be utilized in place of electric motor 22.

Figure 6:
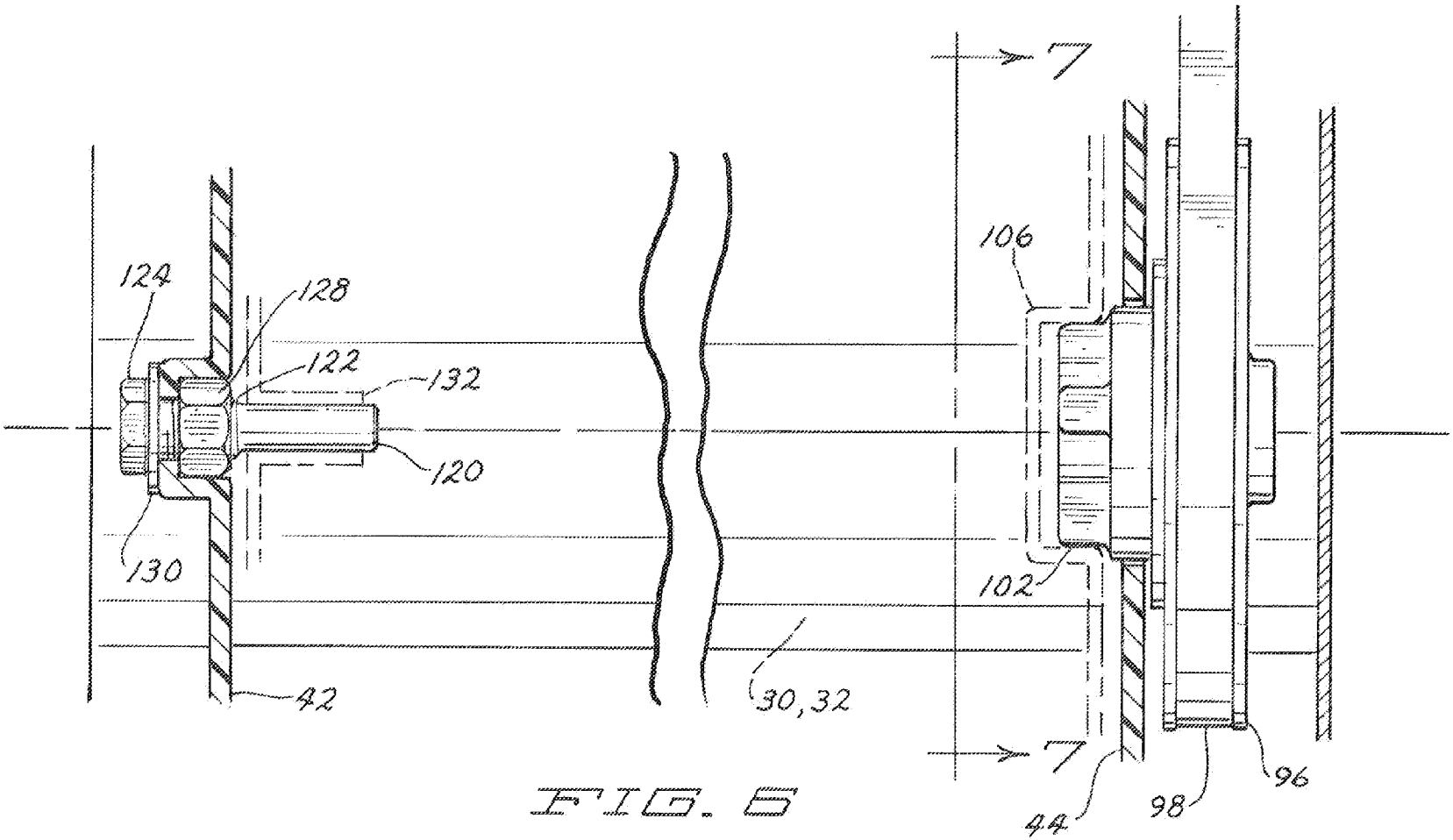
FIG. 6 is a cross-sectional view of the yard tool of FIG. 5 taken along lines 6-6.
Figure 7:
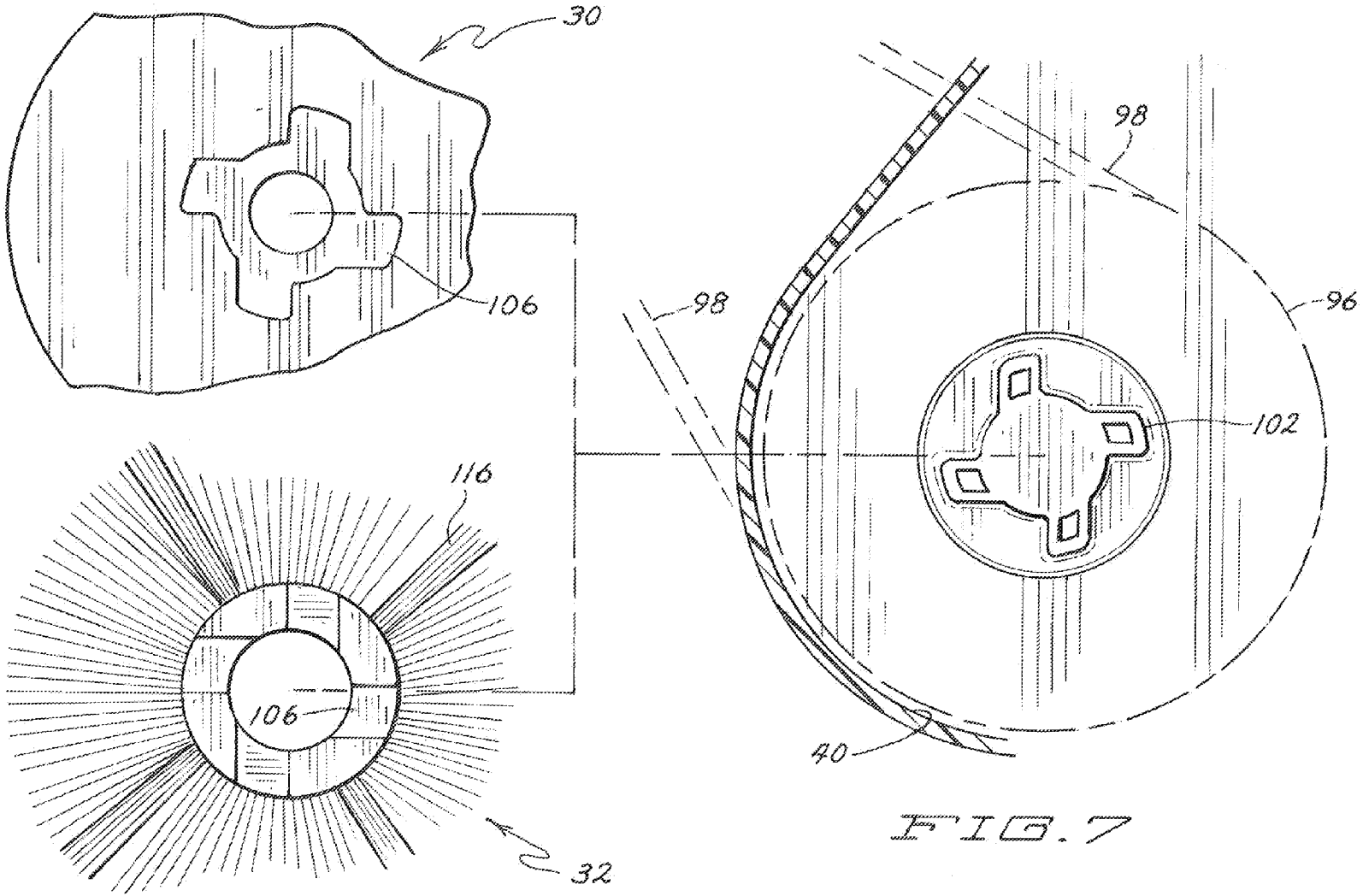
FIG. 7 is a cross sectional view of the yard tool of FIG. 6 taken along lines 7-7 and depicting connections of a snow throwing impeller and a debris sweeping broom.

Referring to FIG. 4, drive motor 22 includes a horizontal drive shaft 90. In addition, coupling means are provided for coupling drive shaft 90 to implements 30, 32 contained inside a drive compartment 92. This coupling means includes a drive pulley 94 connected at one end to shaft 90, a driven pulley 96, an pulley belt 98, and an pulley idler 100. As illustrated in FIGS. 4, 6 and 7, the driven pulley 96 includes an integrated splined drive member. Splined drive member is meant to refer to a conventional drive member having a plurality of lugs, ribs or depressions on the outside surface of a hub. These lugs, ribs or depressions are suited for engaging in corresponding lugs, ribs, notches or grooves on the implement 30, 32. In the illustrated embodiment, the splined drive member defines an outwardly extending lug element 102 which engages a corresponding notch element 106 on an end of implements 30, 32. While the arrangement as disclosed herein is preferred for coupling shaft 90 to implements 30, 32, any other suitable coupling means could also be used, e.g. gears, chains, or the like.

Referring now particularly to FIGS. 1, 2 and 4, in an illustrated embodiment, impeller 30 has an "open center" configuration and may be substantially made from a single piece of plastic. Impeller 30 includes a pair of curved blades 110 which are supported, braced and stiffened by a plurality of "spiders" 112. Curved blades 110 of impeller 30 extend transversely between a pair of somewhat circular plates 114. Additional details of an impeller 30 that may be adapted for use in an embodiment of the present invention are disclosed in U.S. Pat. No. 5,398,431, entitled "Single Stage Snowthrower Impeller," and being incorporated by reference herein. Other impeller 30 configurations may be practicable. The term "impeller" is to be broadly construed to cover a variety of rotatable structures capable of engaging and conveying snow away from housing 12. In other embodiments, impeller 30 may include one or more pliant fingers or fins extending from a central hub. Impeller 30 may be an assembly of polymer, composite and/or metallic components.

Referring to FIG. 2, in an illustrated embodiment broom 32 is generally cylindrical in form and includes a plurality of broom flights 116, each comprising a plurality of fiber bristles. Broom flights 116 are secured to a generally cylindrical broom hub 118 in a curved configuration. In a manner akin to the curved single stage snow impellers disclosed in U.S. Pat. No. 4,694,594, incorporated by reference herein, broom flights 116 include a central debris throwing section which is curved forwardly from its midpoint to each side thereof to be concave, with the central section extending over at least about the middle 50% of the entire broom's length. Two curved end sections are smoothly connected to the curved central section and are shaped to function to move debris inwardly into the central debris throwing section. Broom hub 118 may be of a plastic material. Other broom flight configurations may be practicable. For example, broom flights 116 may extend generally linearly across the broom hub 118. In another example, a flight-less broom 32 having bristles or other ground engaging elements provided upon an elongated hub may be practicable. In yet another embodiment, the broom 32 may comprise a plurality of elastomeric fingers or pliant fins extending from a central drum, such as disclosed in U.S. Pat. No. 5,269,082, incorporated by reference herein.

Implements 30, 32 are releasably contained in compartment 38. Specifically, a stub shaft 120 is releasably affixed to end wall 42 of housing 12. Stub shaft 120 includes a longitudinal shaft 122 and an enlarged head 124. That portion of shaft 122 adjacent head 124 is exteriorly threaded such that it can receive a locknut 128. A washer 130 is provided proximate to the enlarged head 124. Locknut 128 is meant to be located on the inside of end wall 42 with the head 124 being in engagement with the outside surface of end wall 42. When the threaded portion of shaft 122 is tightened into locknut 128, head 124 will be firmly drawn into engagement with end wall 42 in order to affix stub shaft 120 thereto. The end of shaft 120 opposite head 124 is suited to extend inwardly through a bore 132 in the implements 30, 32 and functions to rotatably support the end of implement 30, 32 opposite notch element 106.

Figure 3:
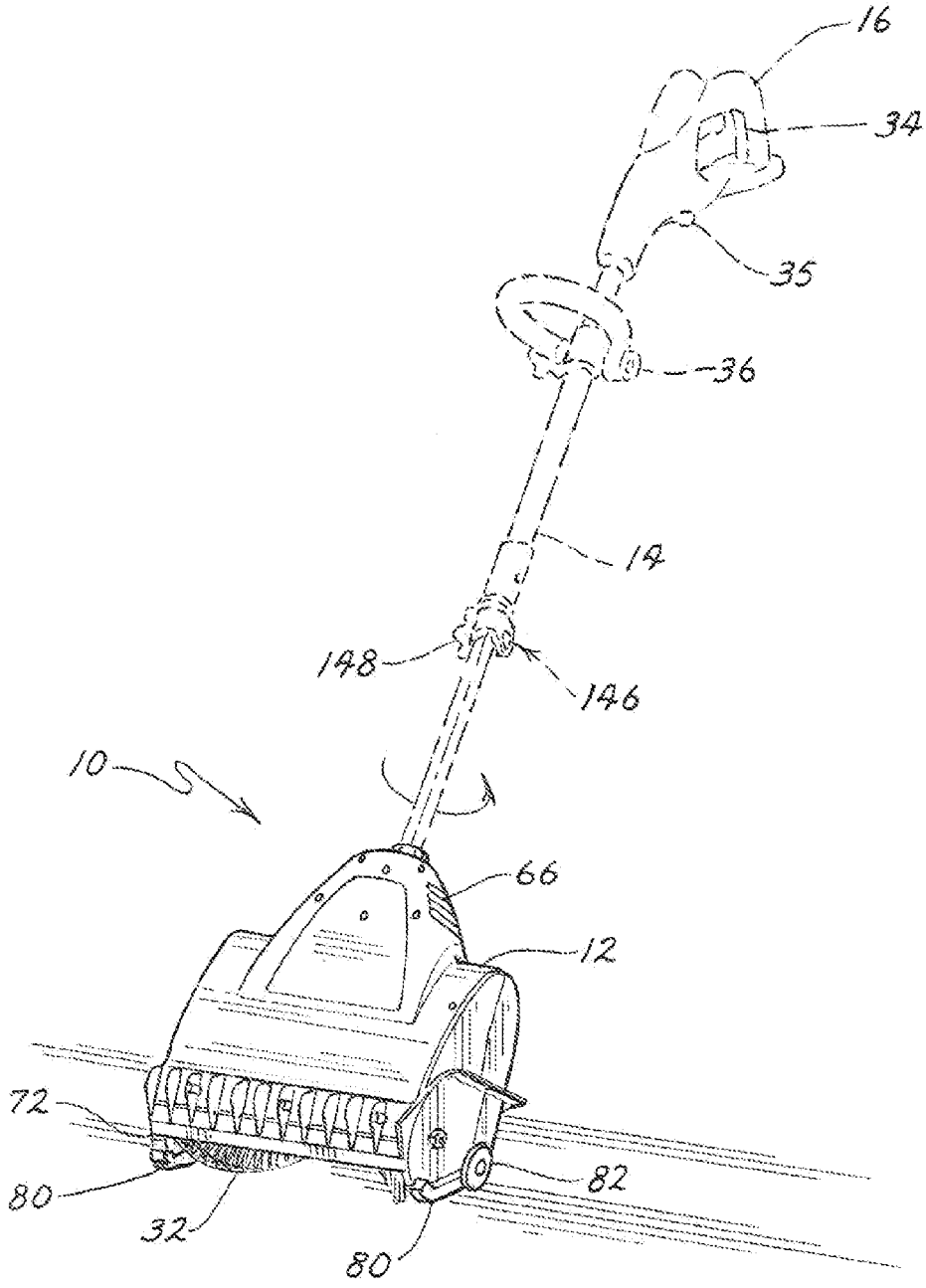
FIG. 3 is a perspective view of the yard tool of FIG. 2 provided in a debris sweeping configuration.

As shown in FIGS. 1 and 3, the handle assembly 14 preferably includes two tubular sections. Preferably, the handle assembly 14 comprises a lower handle tube 140 and an upper handle tube 142. Portions of the lower handle tube 140 are capable of being received into upper handle tube 142 such tubes 140, 142 interfit together in a telescoping arrangement. A coupling 144 surrounds the junction of the two handle tubes 140, 142 and provides a connection between the tubes. A clamp assembly 146 including knob 148 and associated fastener 152 temporarily secure handle tubes 140, 142 together to limit relative movement therebetween. When clamp assembly 146 is loosened, the two handle tubes 140, 142 may be rotated relative to each other so that the orientation of the upper portion of handle assembly 14 and control grip 16 can be rotated relative to housing 12. Preferably, the two handle tubes 140, 142 may be rotated approximately 180 degrees relative to each other.

Assist handle 36 is releasably secured to upper handle tube 142 by a clamping sleeve 152. After releasing clamping forces of sleeve 152, assist handle 36 can be adjusted in position along the upper handle tube 142. Additionally, the angle between the bail 154 of assist handle 36 and upper handle tube 142 can be adjusted. Additional details of a handle 10 and assist handle 36 are provided in copending application Ser. No. 10/975,682, entitled "Adjustable Handle for Portable Tool," assigned to The Toro Company, filed on Oct. 27, 2004, and incorporated by reference herein.

Operation

Referring particularly to FIGS. 1, 3, 8 and 9, two modes of operating tool 10 are illustrated, including a snow throwing mode as depicted in FIGS. 1 and 8 and a debris sweeping mode of FIGS. 3 and 9. Regardless of the mode of operation, to operate tool 10 according to this invention, an electrical cord is first plugged into a suitable electrical outlet or power source. The power plug 35 of yard tool 10 is connected to the energized electrical cord. Then, upon actuation of switch 34, drive motor 22 will be actuated to rotate implement 30, 32 generally in the direction of the arrows B of FIGS. 8 and 9.

In the snow throwing mode, the tool 10 is supported upon the ground or snow surface by scraper bar 72. As illustrated in FIG. 1, the control grip 16 forms a closed loop rearward of the handle assembly 14. The user is able to grasp the top portion of the control grip 16 by inserting his fingers into the opening formed by the closed loop and resting the palm of his hand on the top of the control grip 16. In this position, by squeezing, the user is able to depress an actuating portion of switch 34 projecting from an opening in the underside of the top portion of the handle to close an electric switch and energize the electric motor 22. An additional interlock or safety button (not shown) on control grip 16 may need to be depressed prior to or concurrently with switch 34 being depressed in order to operate tool 10. With impeller 30 rotating, the user, by grasping the control grip 16 with one hand, and grasping the assist handle 36 with the other hand, is able to lift and control the tool 10 to position the implement containing compartment 38 against the ground surface containing the snow which is to be cleared. Rotation of impeller 30 moves the snow through the housing 12 and ejects it in the direction of the arrow A with sufficient force to throw the snow to a point distally located from the tool 10.

To operate the tool in the sweeping mode of operation, the snow impeller implement 30 is exchanged with the sweeping broom 32. Subsequently, to return to the snow throwing mode of operation, the impeller 30 is exchanged with the brush 32. Implements 30, 32 can be easily removed and exchanged or replaced simply by loosening stub shaft 120 by unthreading shaft 122 from locknut 128 and then axially withdrawing stub shaft 120 through end wall 42 until it is disconnected from implements 30, 32. Then, by sliding the implement 30, 32 towards end wall 42 and rotating the implement 30, 32 to clear the lug element 104 of the splined drive member 102, the implement 30, 32 is then freed from compartment 38 and may be removed therefrom. An implement 30, 32 may be put in place using a reverse sequence of movements. Namely, one end of implement 30, 32 is first axially slid so that lug element 104 engages notch element 106 of the splined drive member 102 and then stub shaft 120 is slid inwardly and after passing through washer 130 and locknut 128 is received in bore 132. When stub shaft 120 is tightened in locknut 128, replacement or exchange of implement 30, 32 will be completed. This allows for relatively easy removal and exchange of implements 30, 32.

After the snow impeller 30 has been removed and replaced with the debris broom 32, the panel portion 60 of removable debris shield 58 can be inserted into the channels 52, 54 of side walls 42, 44. End portions of the rod element 62 of debris shield 58 engage respective surfaces of skids 80 and together the skids 80 and channels 52, 54 temporarily secure the debris shield in place. In operation during a debris sweeping operation, as depicted in FIG. 9, the debris shield 58 can be considered as a second "rear wall." In the debris sweeping mode of operation, the debris shield 58 and the broom 32 coact to cause debris which is picked up by broom 32 to be thrown forwardly from housing 12.

To continue with the transition from the snow throwing mode to the debris sweeping mode, a portion of the handle assembly 14 and control g rip 16 are rotated approximately 180 degrees as depicted in FIG. 3. The upper tube 142 of the handle assembly 14 and control grip 16 can be rotated relative to housing 12 by releasing the clamping assembly 146 of the coupling 144. A variety of different coupling allowing for approximately 180 degrees of rotation between the upper tube 142 and the lower tube 140.

The housing 12 can be supported by the wheels 82 and/or skids 80 upon a surface to be cleaned as shown in FIGS. 3 and 9. When so positioned, the control grip 16 can be accessed in a similar manner to that described above with reference to the snow throwing mode of operation. As depicted in FIG. 9, in the sweeping mode of operation, the brush 32 rotates in a direction causing the debris to be thrown forwardly in the direction of travel, C. In comparison, in the snow throwing mode of operation, the impeller 30 rotates in a direction, B, causing snow to be moved rearwardly prior to being ejected from compartment 38.

Yard tool 10 according to this invention is particularly advantageous. For one thing, it is relatively light-weight when compared to prior art snowthrowers and sweepers. Moreover, because the housing is supported upon the ground surface in two different orientations, a undirectional electric motor can be utilized to throw snow rearwardly toward a rear wall during a snow throwing operation and also sweep debris forwardly away from the housing 12 during a debris sweeping operation. This decreases the cost of manufacturing the tool 10 since no motor control is required to reverse direction of motor rotation.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A convertible yard tool assembly comprising:

a rotatable snow impeller;

a rotatable sweeping broom;

a housing defining a compartment, said housing being supported upon a ground surface in at least two operational orientations, wherein with said housing in one operational orientation and said snow impeller rotating within the compartment, the yard tool performs a snow throwing operation by moving snow initially rearwardly relative to a direction of forward machine motion toward a rear portion of the compartment and then upwardly away from the housing, and wherein with said housing in another operational orientation and said sweeping broom rotating within the compartment, the yard tool performs a sweeping operation by moving debris forwardly relative to the direction of forward machine motion and away from a rear portion of the compartment, and wherein said snow impeller and said sweeping broom are rotated in opposite directions relative to the direction of forward machine motion during the snow throwing operation and sweeping operation; and a handle extending from the housing.

2. The convertible yard tool of claim 1 wherein said housing includes a removable debris shield which deflects debris forwardly during the sweeping operation.

3. The convertible yard tool of claim 1 further comprising:

a plurality of ground engaging elements, wherein a first element supports at least part of the yard tool on a snow surface during the snow throwing operation and a second element supports at least some of the yard tool on a ground surface during the sweeping operation.

4. The convertible yard tool of claim 3 wherein the first element is a scraper bar.

5. The convertible yard tool assembly of claim 3 wherein the second element is a skid or a wheel or both.

6. The convertible yard tool assembly of claim 1, further comprising:

a control grip located at an upper portion of the handle, wherein the control grip is rotated about a longitudinal axis of the handle so that the control grip is provided in a generally similar user orientation during both the snow throwing operation and the sweeping operation.

7. The convertible yard tool assembly of claim 1 further comprising:

a selectively removable dust shield which deflects debris thrown by the sweeping broom during the debris sweeping operation.

8. The convertible yard tool assembly of claim 1 further comprising a pair of support elements, wherein the yard tool is supported upon on a snow surface by one of the pair of support elements during the snow throwing operation, and the yard tool is supported on a ground surface by the other one of the pair of support elements when the housing is in a sweeping orientation.

9. The convertible yard tool assembly of claim 1 wherein the handle includes a control grip which is rotated about a longitudinal axis of the handle during a conversion between the snow throwing operation and the debris sweeping operation.

10. The convertible yard tool assembly of claim 9 wherein the control grip is provided in generally the same orientation to the user during the snow throwing operation and the debris sweeping operation.

11. A convertible yard tool comprising:

a debris sweeping broom;

a snow throwing impeller;

a housing defining a compartment, said housing being supported upon a ground surface in at least two operational orientations, wherein with said housing in one operational orientation and said snow throwing impeller rotating within the compartment, the yard tool performs a snow throwing operation by moving snow initially rearwardly relative to a direction of forward machine motion toward a rear portion of the compartment and then upwardly away from the housing, and wherein with said housing in another operational orientation and said debris sweeping broom rotating within the compartment, the yard tool performs a sweeping operation by moving debris forwardly relative to the direction of foward machine motion and away from a rear portion of the compartment, and wherein said snow throwing impeller and said debris sweeping broom are rotated in opposite directions relative to the direction of forward machine motion during the snow throwing operation and sweeping operation; and a handle extending from the housing.

12. The convertible yard tool assembly of claim 11 further comprising a non-reversible electric motor which rotates the snow impeller or the broom.

13. The convertible yard tool of claim 11 further comprising a control grip provided at an upper portion of the handle.

14. A convertible yard tool assembly comprising a debris sweeping broom;

a snow throwing impeller;

a housing operated relative to a ground surface in either a snow throwing orientation or a sweeping orientation, wherein said impeller throws snow rearwardly toward a wall surface of the housing during a snow throwing operation, and wherein said broom sweeps debris forwardly relative to the housing during a sweeping operation, and when viewed from a side of the housing, said snow impeller being rotated in a counter-clockwise direction during the snow throwing operation, and said sweeping broom being rotated in a clockwise direction during the sweeping operation;

a handle extending from the housing; and a control grip provided at an upper portion of the handle, wherein the control grip is rotated approximately 180 degrees about a longitudinal axis of the handle during a change from the snow throwing operation to the sweeping operation.

15. The convertible yard tool assembly of claim 11 further comprising a wheel and a scraper bar, wherein the housing is supported upon the wheel during the sweeping operation and the housing is supported upon the scraper bar during the snow throwing operation.

16. The convertible yard tool assembly of claim 11 further comprising a dust shield positioned between the broom and a user during the sweeping operation.

17. The convertible yard tool assembly of claim 16 wherein the dust shield is removed prior to the snow throwing operation.

18. A convertible yard tool comprising:

a housing adapted to carry a snow impeller or a sweeping broom;

an electric motor which rotates the snow impeller or the sweeping broom within the housing, said housing being supported upon a ground surface in at least two operational orientations, wherein with said housing in one operational orientation and said snow impeller rotating within the compartment, the yard tool performs a snow throwing operation by moving snow initially rearwardly relative to a direction of forward machine motion toward a rear portion of the compartment and then upwardly away from the housing, and wherein with said housing in another operational orientation and said sweeping broom rotating within the compartment, the yard tool performs a sweeping broom are rotated in opposite direction relative to the direction of forward machine motion during the snow throwing operation and sweeping operation; and a handle extending from the housing.

* * * * *

UNITED STATES PATENT AND TRADEMARK OFFICE

CERTIFICATE OF CORRECTION

PATENT NO. : 7,257,909 B2
APPLICATION NO. : 10/975683
DATED : August 21, 2007
INVENTOR(S) : Chadwick A. Shaffer et al.

It is certified that error appears in the above-identified patent and that said Letters Patent is hereby corrected as shown below:

Col. 10, line 40;

At claim 18, line 16, after "sweeping" insert --operation by moving debris forwardly relative to the direction of forward machine motion and away from a rear portion of the compartment, and wherein said snow impeller and said sweeping--.

Col. 10, line 41,

At claim 18, line 17; delete "direction" and insert --directions--.

Signed and Sealed this

Thirtieth Day of October, 2007

JON W. DUDAS
*Director of the United States Patent and Trademark Office*